US011491808B2

(12) United States Patent
Hayakawa et al.

(10) Patent No.: US 11,491,808 B2
(45) Date of Patent: Nov. 8, 2022

(54) PRINTING APPARATUS, TRANSPORT CONTROL METHOD

(71) Applicant: SEIKO EPSON CORPORATION, Tokyo (JP)

(72) Inventors: Naoto Hayakawa, Matsumoto (JP); Yasushi Yajima, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 17/130,529

(22) Filed: Dec. 22, 2020

(65) Prior Publication Data

US 2021/0197590 A1 Jul. 1, 2021

(30) Foreign Application Priority Data

Dec. 26, 2019 (JP) ..... JP2019-237292

(51) Int. Cl.
*B41J 11/70* (2006.01)

(52) U.S. Cl.
CPC ..... *B41J 11/70* (2013.01)

(58) Field of Classification Search
CPC . B41J 11/66; B41J 11/663; B41J 11/70; B41J 11/706; B41J 13/00; B41J 13/0009; B41J 13/0027; B41J 13/0036; B41J 13/0045; B41J 3/4075
See application file for complete search history.

(56) References Cited

U.S. PATENT DOCUMENTS

2011/0089628 A1 4/2011 Watanabe et al.
2014/0011654 A1* 1/2014 Maeda ..... B23Q 15/00 493/369
2018/0257411 A1* 9/2018 Kato ..... B41J 2/32
2020/0307270 A1* 10/2020 Yamaguchi ..... B41J 11/663

FOREIGN PATENT DOCUMENTS

JP 2013-199384 10/2013
JP 2015-063382 4/2015

* cited by examiner

*Primary Examiner* — Scott A Richmond
(74) *Attorney, Agent, or Firm* — Workman Nydegger

(57) ABSTRACT

A transport unit configured to transport a medium, a printing unit configured to perform printing on the medium, and a cutting unit configured to cut the medium are provided, the cutting unit located downstream of the printing unit cuts the medium into a base portion upstream of the cutting unit, and a cut piece downstream of the cutting unit, and the transport unit, with an upstream end of the cut piece in a state of being superposed over the base portion, transports the upstream end of the cut piece from downstream of the cutting unit to upstream of the cutting unit.

8 Claims, 13 Drawing Sheets

PRINTING APPARATUS, TRANSPORT CONTROL METHOD

The present application is based on, and claims priority from JP Application Serial Number 2019-237292, filed Dec. 26, 2019, the disclosure of which is hereby incorporated by reference herein in its entirety.

BACKGROUND

1. Technical Field

The present disclosure relates to a printing apparatus, a transport control method.

2. Related Art

For example, as in JP 2015-63382 A, there is a recording device that is an example of a printing apparatus in which a recording unit, which is an example of a printing unit, prints on an elongated medium. The recording device cut the printed medium with a shearing unit, which is an example of a cutting unit, to form a single sheet, which is an example of a cut piece, and then the single sheet was discharged from a discharge port.

The medium is printed in the middle of transport from upstream to downstream, and a printed portion is cut by the cutting unit. A transport path through which the medium is transported may partially vary in height. For example, the transport path may be set such that an upstream height of the cutting unit at which the elongated medium is located is shorter than a downstream height of the cutting unit at which the cut piece cut off is located, in order to stabilize posture of the medium during the cutting. Thus, it was difficult to transport the cut piece, which is located downstream of the cutting unit, to upstream of the cutting unit.

SUMMARY

A printing apparatus for solving the above-described problems includes a transport unit configured to transport a medium, a printing unit configured to perform printing on the medium, and a cutting unit configured to cut the medium, wherein the cutting unit located downstream of the printing unit cuts the medium into a base portion upstream of the cutting unit, and a cut piece downstream of the cutting unit, and the transport unit, with an upstream end of the cut piece in a state of being superposed over the base portion, transports the upstream end of the cut piece from downstream of the cutting unit to upstream of the cutting unit.

A transport control method for solving the above-described problems is a transport control method for a printing apparatus including a transport unit configured to transport a medium, a printing unit configured to perform printing on the medium, and a cutting unit configured to cut the medium, that includes a forward feeding step for transporting downstream the medium printed by the printing unit, a cutting step for, after the forward feeding step, cutting, by the cutting unit, the printed medium into a base portion upstream of the cutting unit and a cut piece downstream of the cutting unit, an superposing step for superposing an upstream end of the cut piece above the base portion, and a reverse feeding step for, with the upstream end of the cut piece in a state of being superposed over the base portion, transporting the cut piece from downstream of the cutting unit to upstream of the cutting unit.

DESCRIPTION OF EXEMPLARY EMBODIMENTS

Figure 1:
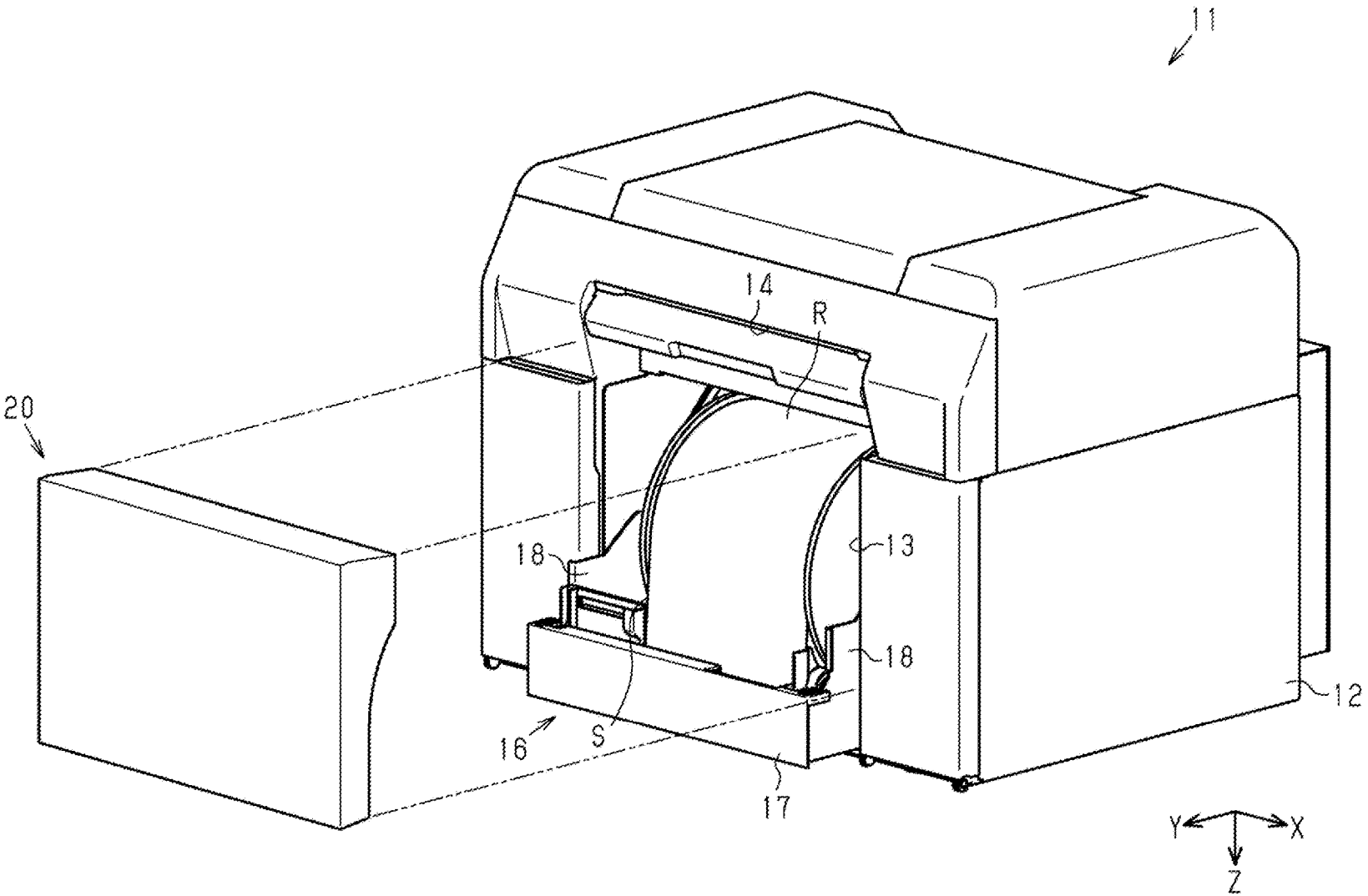
FIG. 1 is a perspective view of an exemplary embodiment of a printing apparatus.

An exemplary embodiment of a printing apparatus, a transport control method will be described below with reference to the accompanying drawings. The printing apparatus is, for example, an ink-jet type printer configured to discharge ink on a medium such as a sheet and to perform printing.

In the drawings, a direction of gravity is indicated by a Z-axis while assuming that a printing apparatus 11 is placed on a horizontal surface, and directions along the horizontal surface are indicated by an X-axis and a Y-axis. The X-, Y-, and Z-axes are orthogonal to each other. In the following description, a direction parallel to the X-axis is also referred to as a width direction X, and a direction parallel to the Z-axis direction is also referred to as a vertical direction Z.

As illustrated in FIG. 1, the printing apparatus 11 of the present exemplary embodiment includes a housing 12. The housing 12 may have an opening portion 13 that opens to a front face and a discharge port 14 through which a printed medium S is discharged.

The printing apparatus 11 may include a feeding portion 16 that feeds the medium S from a roll body R around which the medium S that is elongated is wound in a cylindrical shape. The feeding portion 16 may be accommodated within the housing 12 in a state of being extractable from the housing 12 through the opening portion 13. The feeding portion 16 may include a front plate portion 17 that configures a part of an outer packaging of the printing apparatus 11 when accommodated in the housing 12, and a pair of support walls 18 that rotatably support the roll body R.

The printing apparatus 11 may include an accommodating portion 20 capable of accommodating a portion cut off from the elongated medium S. The accommodating portion 20 may be removably attached to the housing 12. The accommodating portion 20 of the present exemplary embodiment closes the opening portion 13 by being attached to the housing 12. When the accommodating portion 20 is removed from the housing 12, the feeding portion 16 is ready to be pulled out of the housing 12.

Figure 2:
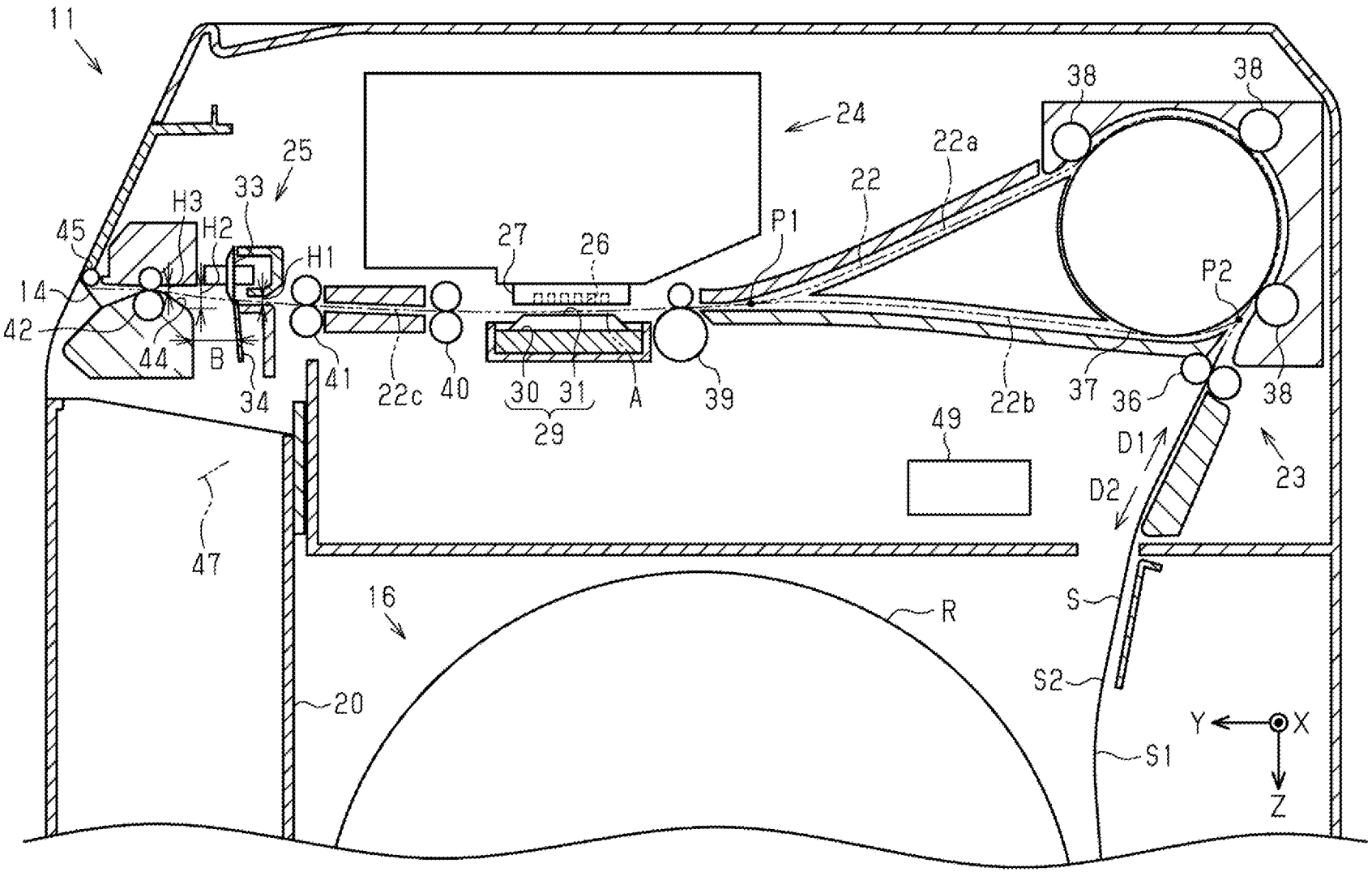
FIG. 2 is a cross-sectional view illustrating a configuration of the printing apparatus.

As illustrated in FIG. 2, the printing apparatus 11 includes a transport path 22 indicated by a double dot chain line through which the medium S is transported. The printing apparatus 11 includes a transport unit 23 transporting the medium S along the transport path 22, a printing unit 24 printing on the medium S, and a cutting unit 25 cutting the medium S.

The printing unit 24 includes a discharge head 27 including a nozzle 26 capable of discharging ink. The discharge head 27 may be a line head type capable of discharging ink simultaneously in substantially all regions in the width direction X of the medium S, or may be a serial head type discharging ink while reciprocating in the width direction X and a direction opposite to the width direction X.

The printing apparatus 11 may include a support portion 29 supporting a portion of the elongated medium S on which printing is performed by the printing unit 24 from below in the vertical direction Z. The support portion 29 of the present exemplary embodiment includes an ink receiver 30 receiving ink discharged from the printing unit 24, and a support face 31 supporting the medium S. The ink receiver 30 may be formed of an absorbent body that absorbs ink. The ink receiver 30, for example, when the printing unit 24 performs frameless printing, receives ink discharged outside the medium S. The support face 31 is located above the ink receiver 30 in the vertical direction Z. In other words, the support face 31 is located between the discharge head 27 and the ink receiver 30. In the present exemplary embodiment, a region between the support face 31 and the discharge head 27 in the transport path 22 is referred to as a print region A. The printing unit 24 performs printing on a portion located in the print region A of the medium S.

The transport path 22 is a space in which the medium S is movable, and is constituted by a plurality of members. The transport path 22 continues from the feeding portion 16 located at an uppermost stream to the discharge port 14 located at a lowermost stream. The printing unit 24 and the support portion 29 constitute a part of the transport path 22.

The cutting unit 25 is located downstream from the printing unit 24 and is located upstream from the discharge port 14. The cutting unit 25 of the present exemplary embodiment includes a movable blade 33 that is reciprocally movable in the width direction X and in the direction opposite to the width direction X, and a fixed blade 34 that does not move. The fixed blade 34 is provided below the transport path 22, and the movable blade 33 is provided above the transport path 22. The cutting unit 25 cuts the medium S along the width direction X at a cutting location. The cutting location is a location of a blade edge of the fixed blade 34.

The transport path 22 may have a supply path 22*a* and a reverse path 22*b* upstream from the print region A, and a discharge path 22*c* downstream from the print region A. The supply path 22*a* is a passage that connects the feeding portion 16 with the print region A. The reverse path 22*b* is a passage that connects a branch point P1 from which the reverse path 22*b* branches from the supply path 22*a*, with a joining point P2 at which the reverse path 22*b* joins with the supply path 22*a*. In the supply path 22*a*, the joining point P2 is located upstream from the branch point P1. The discharge path 22*c* is a passage that connects the print region A with the discharge port 14.

The transport unit 23 unwinds the medium S from the roll body R around which the medium S is wound, and transports the medium S. The transport unit 23 may include a pair of feed rollers 36, a reverse roller 37, a driven roller 38, and a pair of upstream transport rollers 39 that are provided in order from upstream in the supply path 22*a*. The transport unit 23 may include a plurality of the driven rollers 38. The driven roller 38 is rotatably provided, and is driven and rotated with the medium S interposed between the driven roller 38 and the reverse roller 37. The transport unit 23 may have a pair of downstream transport rollers 40, a pair of first rollers 41, and a pair of second rollers 42 provided in order from upstream in the discharge path 22*c*. The pair of first rollers 41 are located upstream from the cutting unit 25. The pair of second rollers 42 are located downstream from the cutting unit 25.

The pair of feed rollers 36, the reverse roller 37, the driven roller 38, the pair of upstream transport rollers 39, the pair of downstream transport rollers 40, the pair of first rollers 41, and the pair of second rollers 42 rotate with the medium S interposed, to transport the medium S. The transport unit 23 is driven forward to transport the medium S from upstream to downstream, and is reversely driven to transport the medium S from downstream to upstream. In the present exemplary embodiment, a downstream direction along the transport path 22 is referred to as a forward feeding direction D1, and an upstream direction is referred to as a reverse feeding direction D2.

The printing apparatus 11 may include a contact portion 44 provided upstream from the pair of second rollers 42, and a guide portion 45 provided downstream from the pair of second rollers 42. The guide portion 45 of the present exemplary embodiment is constituted by a rotatable roller, and is provided on a ceiling of the transport path 22. The ceiling of the transport path 22 is a ceiling that defines a range through which the medium S can pass through, that is located above the medium S in the vertical direction Z.

The contact portion 44 is located between the cutting unit 25 and the pair of second rollers 42, and is provided separated from the cutting unit 25 in the forward feeding direction D1. In other words, the fixed blade 34 included in the cutting unit 25, and a member having the contact portion 44 form a gap B. The cutting unit 25, the contact portion 44, and the gap B are located above the accommodating portion 20. A removed cut piece 47 cut off from the elongated medium S falls through the gap B and is accommodated in the accommodating portion 20. In other words, the accommodating portion 20 accommodates the removed cut piece 47 cut off from the medium S.

The transport path 22 of the present exemplary embodiment has a height in the vertical direction Z that is not constant from upstream to downstream, but partially varies. For example, the transport path 22 is configured such that a first height H1 upstream from the cutting unit 25 is smaller than a second height H2 downstream from the cutting unit 25. The second height H2 is a height of the transport path 22 at an upstream end of the contact portion 44. A third height H3, which is a height of the transport path 22 at a downstream end of the contact portion 44, is smaller than the second height H2. The contact portion 44 of the present exemplary embodiment is an upward inclined surface in which a downstream end is located above an upstream end, and that inclines upward in the forward feeding direction D1.

The printing apparatus 11 includes a control unit 49 controlling various operations performed by the printing apparatus 11. The control unit 49 is configured, for example, from a processing circuit including a computer and a memory, and the like, and controls the printing unit 24, the cutting unit 25, the transport unit 23, and the like in accordance with a program stored in the memory.

Next, actions of the present exemplary embodiment will be described.

The printing apparatus 11 transports the medium S by the transport control method including a forward feeding step, a cutting step, an superposing step, and a reverse feeding step. The transport control method may perform a feeding step for feeding the medium S, a first printing step and a second printing step for printing on the medium S, a cut-off step for cutting off an end of the medium S, and reverse step for reversing the medium S. When performing frameless printing on both sides of the medium S, the printing apparatus 11 of the present exemplary embodiment performs the feeding step, the first printing step, the cut-off step, the forward feeding step, the cutting step, the superposing step, the reverse feeding step, the reverse step, the second printing step, and the cut-off step in order.

The control unit 49 may perform drive control of each of mechanisms based on drive times of the pair of upstream transport rollers 39, the reverse roller 37, and the like. The printing apparatus 11 may include a sensor for detecting an amount of rotation of the pair of upstream transport rollers 39, the reverse roller 37, and the like. The printing apparatus 11 may include a sensor for detecting the medium S. The control unit 49 may perform drive control of each of the mechanisms based on a detection result of the sensor.

Figure 3:
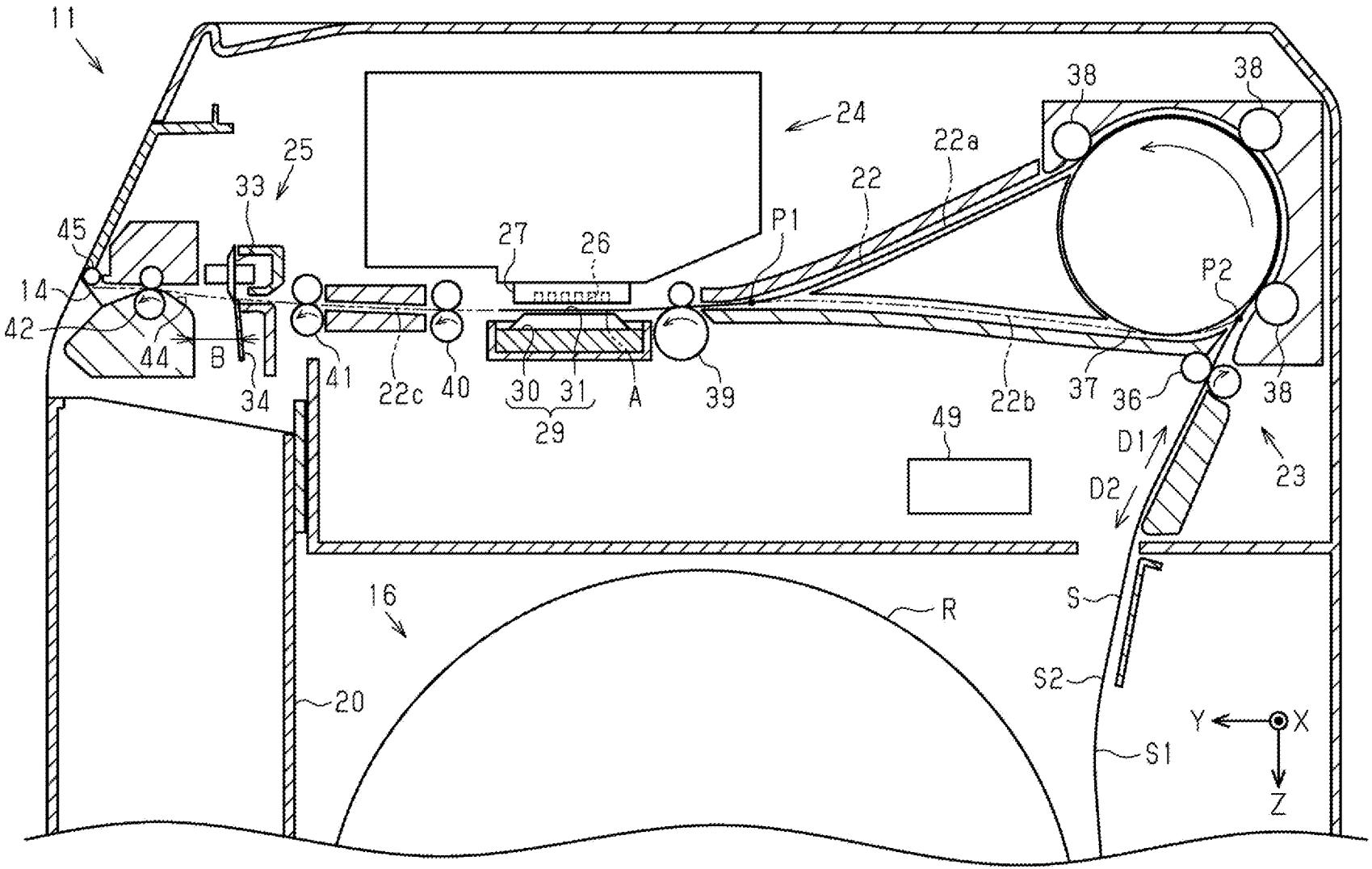
FIG. 3 is a cross-sectional view illustrating a feeding step and a first printing step of the printing apparatus.

As illustrated in FIG. 3, the control unit 49 performs the feeding step for driving the transport unit 23, and transporting the medium S unwound from the roll body R along the supply path 22*a* to the print region A. Specifically, the control unit 49 drives the transport unit 23 forward to transport the medium S in the forward feeding direction D1, and transports the medium S fed from the feeding portion 16 to the print region A.

The control unit 49 performs the first printing step for discharging ink from the printing unit 24 and printing on a first surface S1 of the medium S. The medium S has the first surface S1, which is an outer surface in a state of the roll body R, and a second surface S2, which is an inner surface. In the first printing step, while the transport unit 23 transports the medium S in the forward feeding direction D1, the printing unit 24 discharges ink toward the medium S located in the print region A to perform printing. The printing unit 24 may print on a printed range separated from a downstream end of the medium S, and leave a margin portion at the downstream end.

Figure 4:
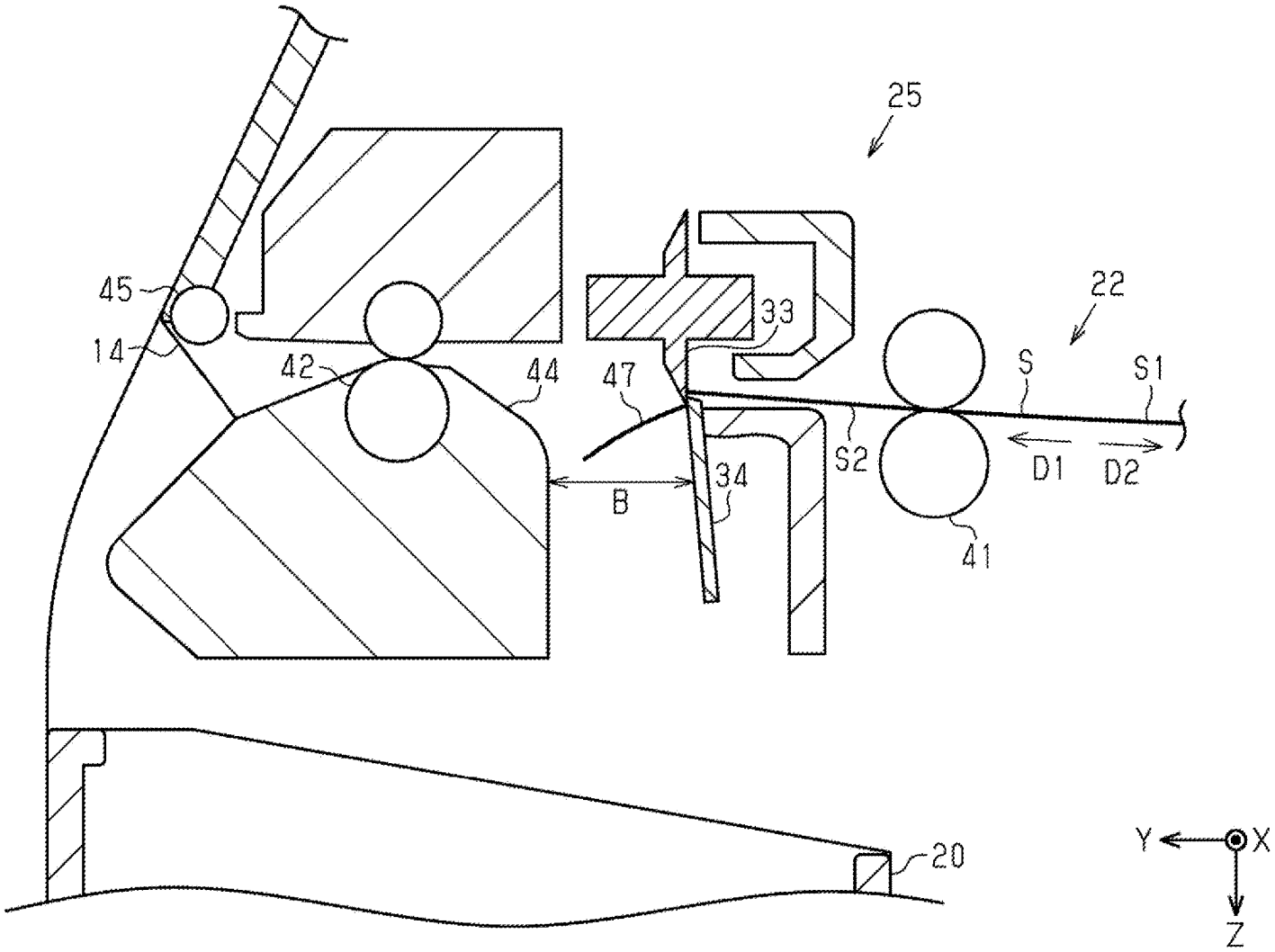
FIG. 4 is a cross-sectional view illustrating a cut-off step of the printing apparatus.

As illustrated in FIG. 4, when the margin portion passes through a cutting location and is located downstream from the cutting location, the control unit 49 performs the cut-off step in which the cutting unit 25 cuts off the removed cut piece 47 from the medium S. The cut-off step is performed while the transport of the medium S is stopped. In the cut-off step, a margin portion and a part of a printed portion printed may be cut off. The removed cut piece 47 that is cut off falls through the gap B and is collected in the accommodating portion 20.

When a length from the print region A to the cutting unit 25 is smaller than a length of a single printed range to be cut off from the medium S, the control unit 49 performs the cut-off step in the middle of the first printing step. When the length from the print region A to the cutting unit 25 is larger than the length of the single printed range to be cut off from the medium S, the control unit 49 performs the cut-off step after the first printing step ends.

Figure 5:
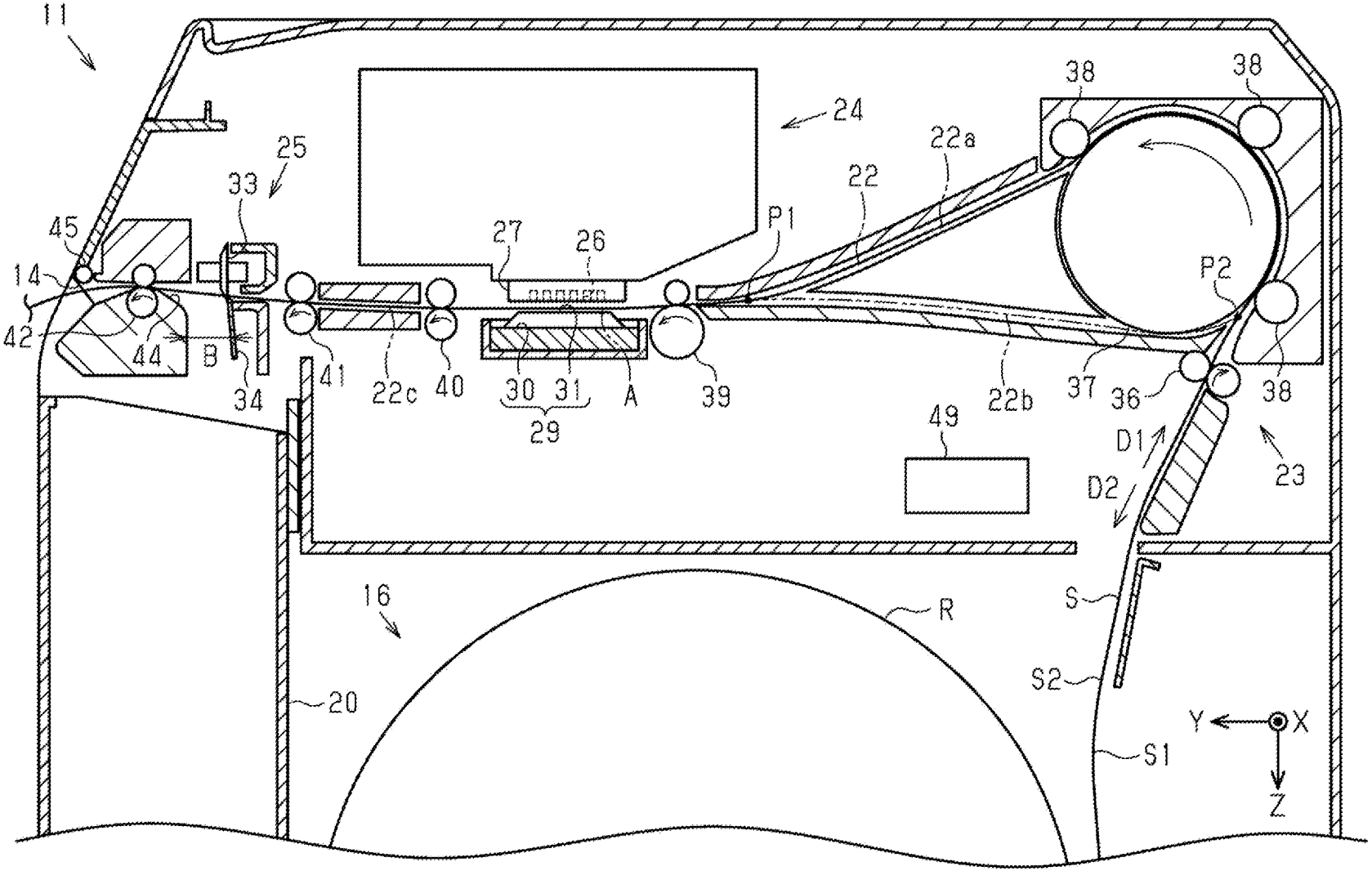
FIG. 5 is a cross-sectional view illustrating a forward feeding step of the printing apparatus.

As illustrated in FIG. 5, the control unit 49 performs the forward feeding step for transporting the medium S printed upstream by the printing unit 24 downstream. In the forward feeding step, the control unit 49 drives the transport unit 23 forward, and transports the medium S in the forward feeding direction D1. When the printed portion printed by the first printing step passes through the cutting location, the control unit 49 stops transporting the medium S. The control unit 49 may stop transporting such that a margin portion is formed between the printed portion and the cutting unit 25.

Figure 6:
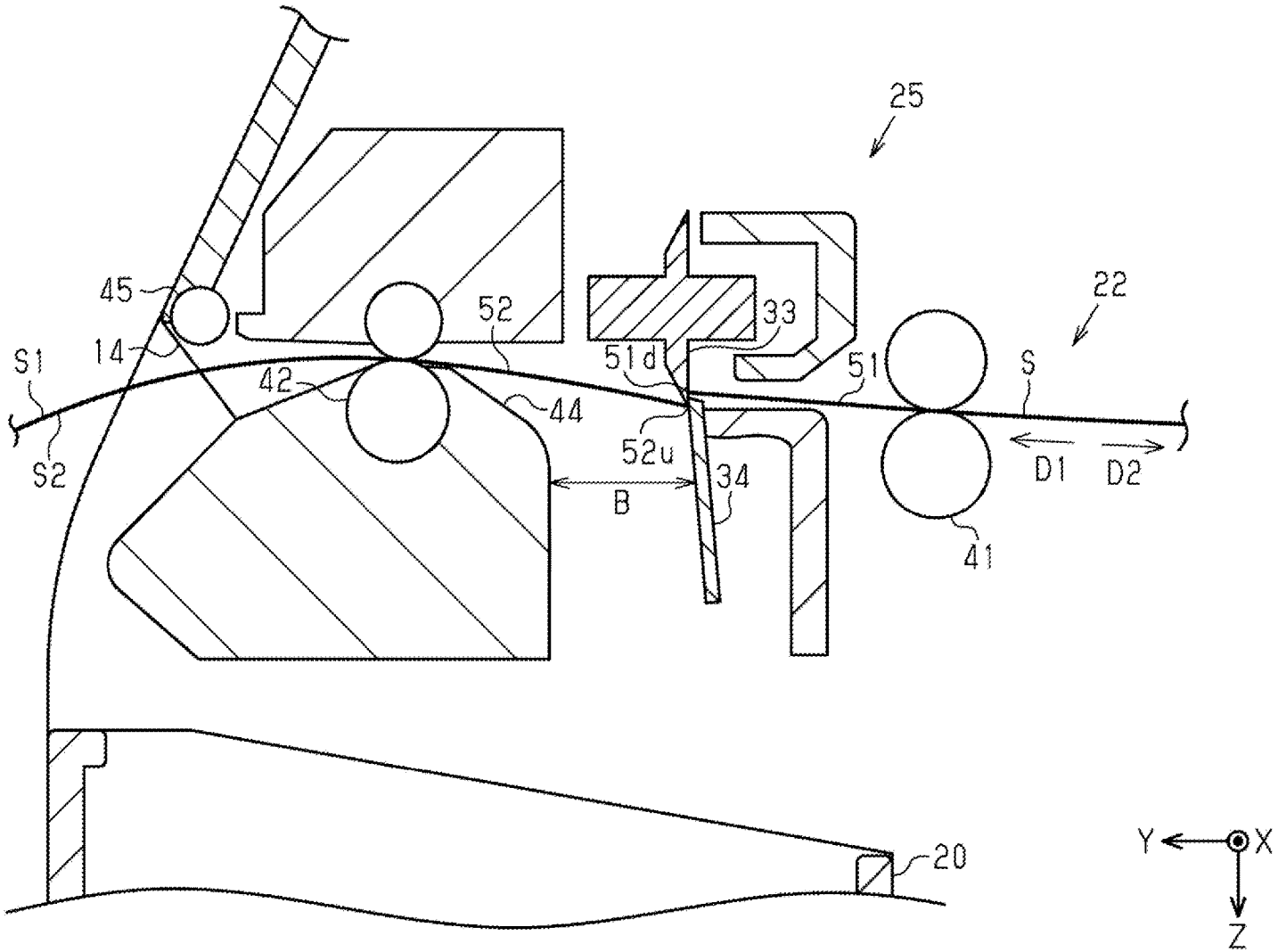
FIG. 6 is a cross-sectional view illustrating a cutting step of the printing apparatus.

As illustrated in FIG. 6, the control unit 49 performs the cutting step in which the cutting unit 25 cuts the printed medium S after the forward feeding step. The cutting unit 25 cuts the medium S in a state where the transporting is stopped into a base portion 51 upstream from the cutting unit 25, and a cut piece 52 downstream from the cutting unit 25. At this time, the pair of first rollers 41 hold the base portion 51 upstream from the cutting unit 25, and the pair of second rollers 42 hold the cut piece 52 downstream from the cutting unit 25. In other words, the pair of second rollers 42 of the present exemplary embodiment also function as a holding unit that holds the cut piece 52 downstream from the cutting unit 25.

Downstream from the pair of second rollers 42, a guide portion 45 that is capable of contacting an upper surface of the cut piece 52 to guide the cut piece 52 is provided. Thus, a printed surface of each of the medium S before the cutting and the cut piece 52 after the cutting is guided by the guide portion 45.

Figure 7:
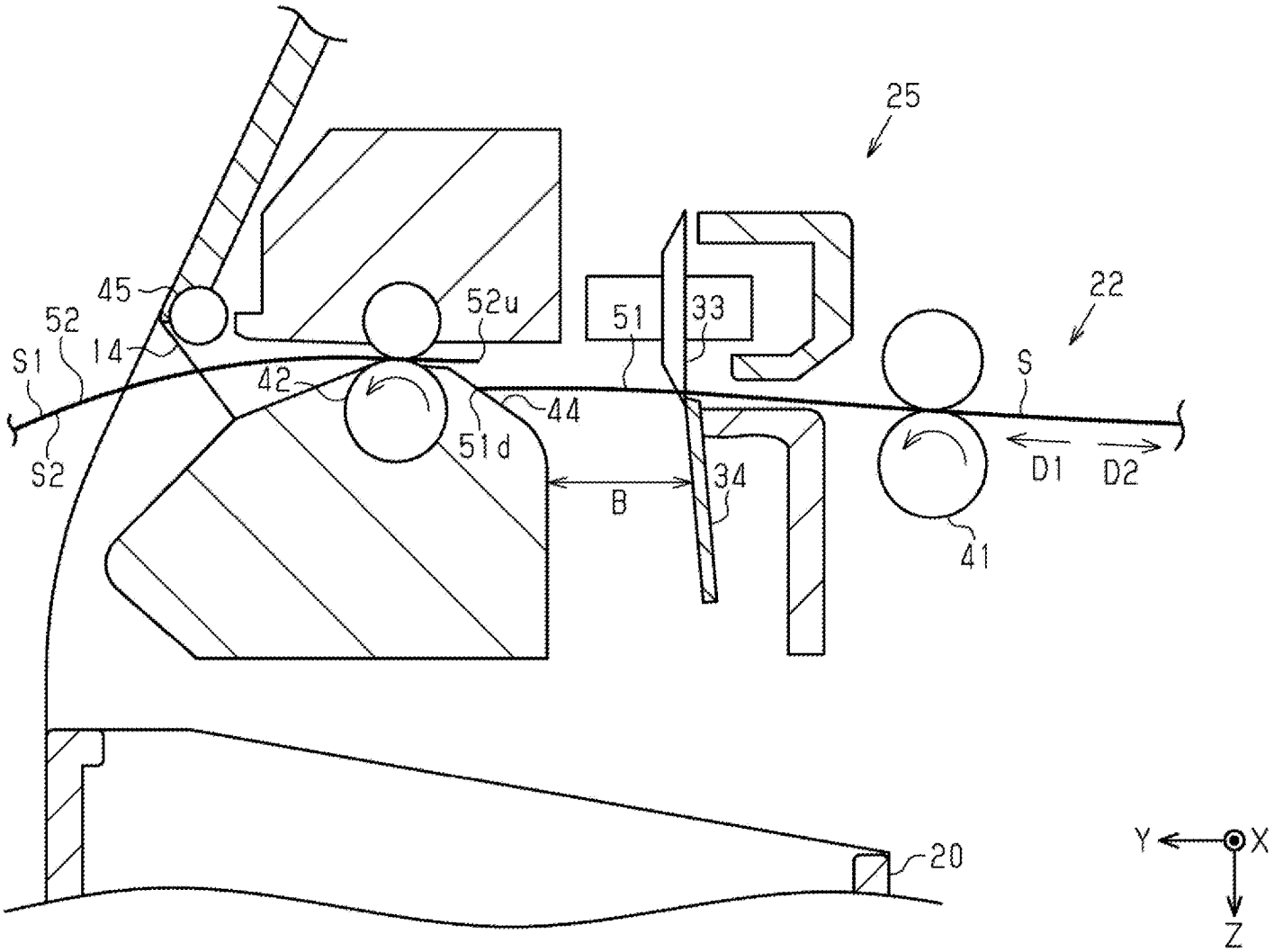
FIG. 7 is a cross-sectional view illustrating an superposing step of the printing apparatus.
Figure 8:
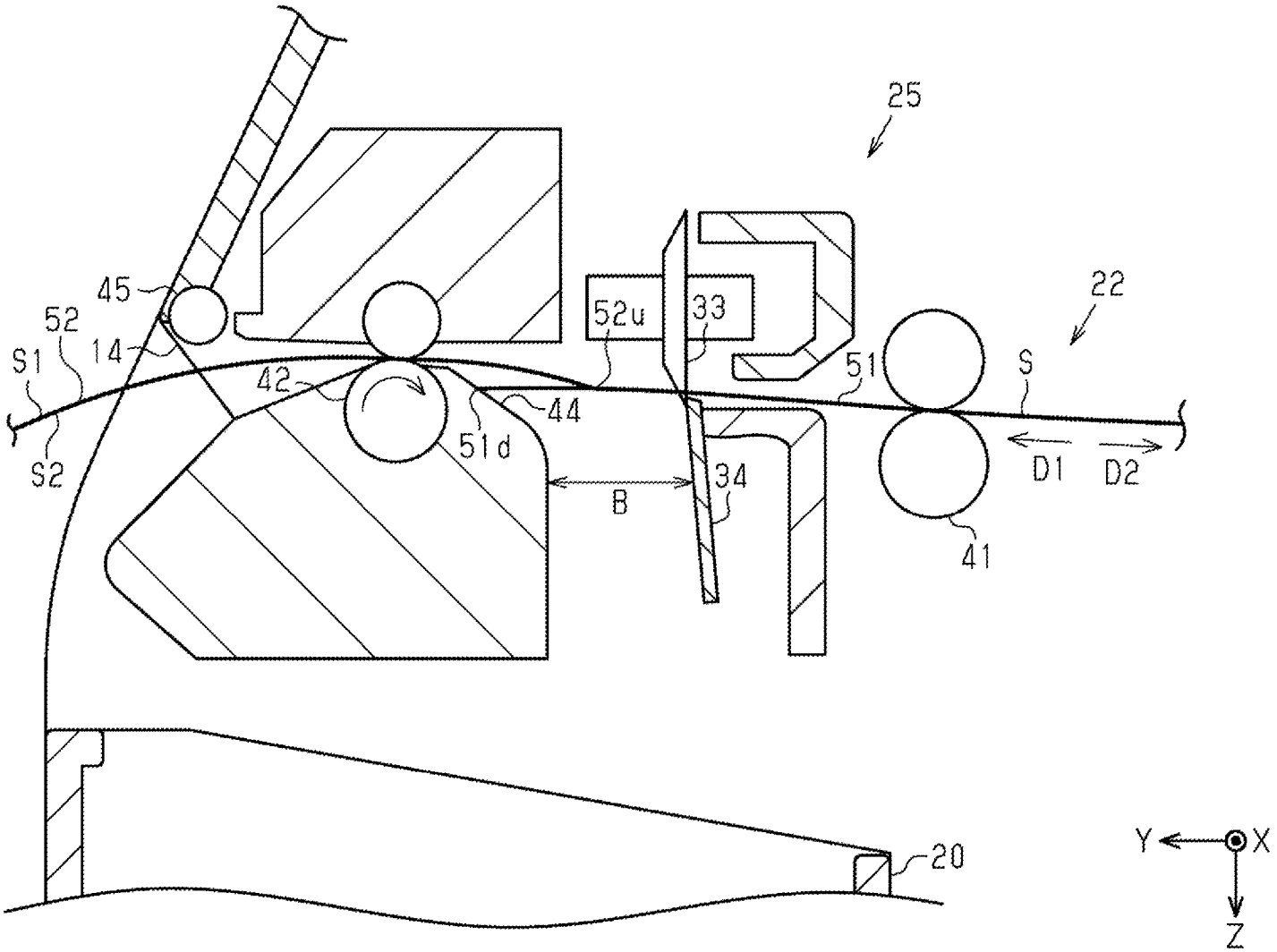
FIG. 8 is a cross-sectional view illustrating the superposing step of the printing apparatus.

As illustrated in FIGS. 7 and 8, the control unit 49 performs the superposing step for superposing an upstream end 52*u* of the cut piece 52 with the base portion 51. In the superposing step, the control unit 49 first drives the transport unit 23 forward as illustrated in FIG. 7 to transport the base portion 51 and the cut piece 52 in the forward feeding direction D1. Subsequently, as illustrated in FIG. 8, the control unit 49 drives the pair of second rollers 42 reversely, in a state where the driving of the pair of first rollers 41 is stopped.

As illustrated in FIG. 7, the gap B for dropping the removed cut piece 47 is provided between the cutting unit 25 and the contact portion 44. As such, the base portion 51 passing through the cutting unit 25 travels downward so as to hang down by a curl made when wound in the cylindrical shape and own weight thereof, and a downstream end 51*d* of the base portion 51 comes into contact with the contact portion 44. When the base portion 51 comes into contact with the contact portion 44, the control unit 49 stops driving the transport unit 23, and stops transporting the base portion 51 and the cut piece 52.

The cutting location where the cutting unit 25 cuts the medium S and the contact portion 44 are located below a holding position where the pair of second rollers 42 sandwich and hold the cut piece 52. A distance from the cutting location to the contact portion 44 is greater than a distance from the holding position to the contact portion 44. Thus, when the downstream end 51*d* of the base portion 51 contacts the contact portion 44, the upstream end 52*u* of the cut piece 52 is located above the contact portion 44. In other words, the contact portion 44 is able to contact the downstream end 51*d* of the base portion 51 below the upstream end 52*u* of the cut piece 52 in a state of being held by the pair of second rollers 42 in the vertical direction Z.

As illustrated in FIG. 8, when the pair of second rollers 42 are reversely driven while driving the pair of first rollers 41 is stopped, the upstream end 52*u* of the cut piece 52 overlaps with the base portion 51. The overlapping at this point refers to a state where the upstream end 52*u* of the cut piece 52 is located upstream from the downstream end 51*d* of the base portion 51, and includes not only a state where the cut piece 52 is in contact with the base portion 51, but also a state where the cut piece 52 is separated from the base portion 51. The upstream end 52*u* of the cut piece 52 is located above the base portion 51 in a state of overlapping with the base portion 51. In the cut piece 52 and the base portion 51, when an amount of mutual overlapping is less than a margin portion, for example, even when an overlapped portion is rubbed and scratched, the portion can be cut off as the removed cut piece 47.

Figure 9:
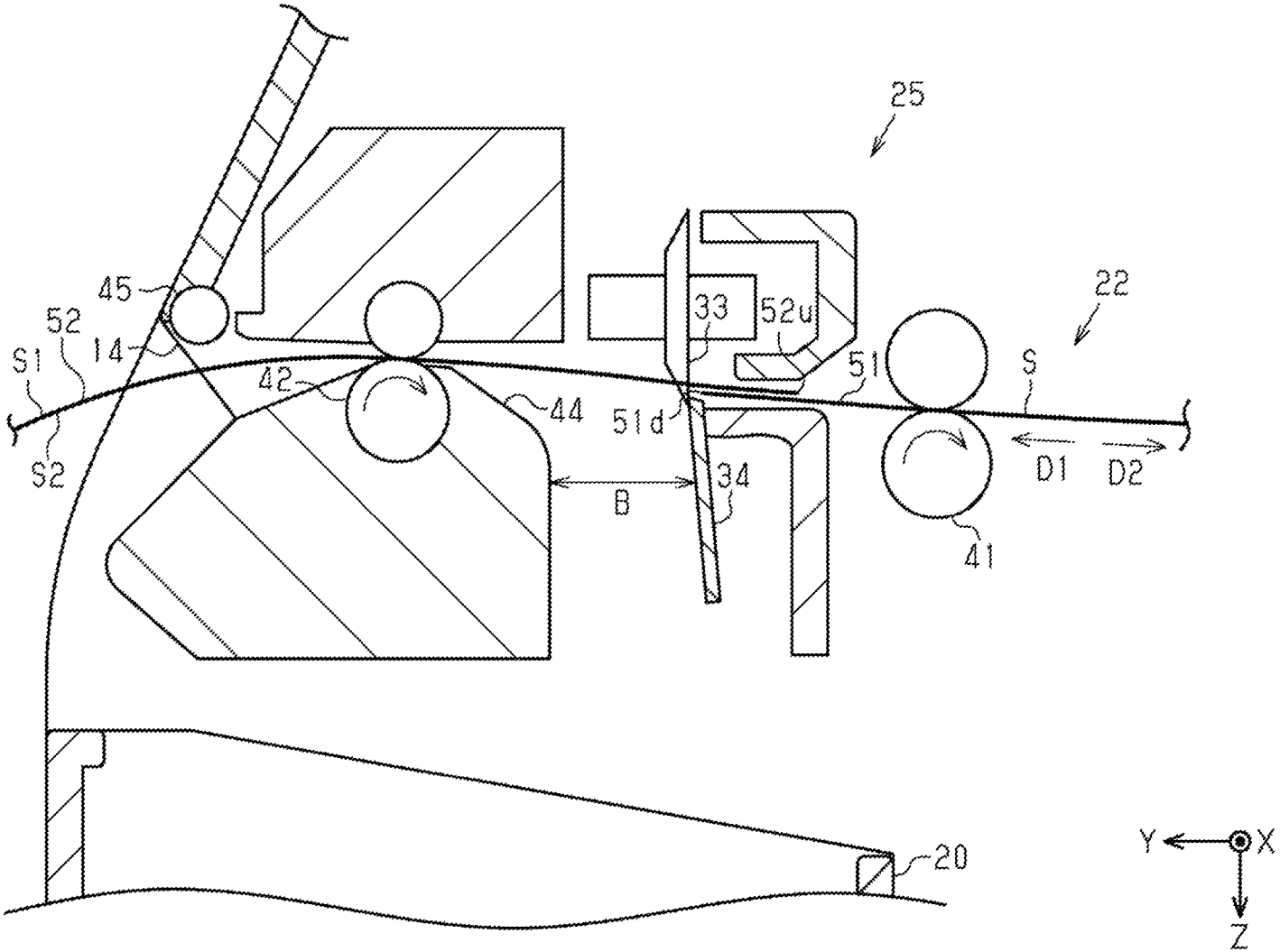
FIG. 9 is a cross-sectional view illustrating a reverse feeding step of the printing apparatus.

As illustrated in FIG. 9, the control unit 49 performs the reverse feeding step in which the cut piece 52 is transported upstream from downstream such that the upstream end 52*u* of the cut piece 52 passes through the cutting unit 25 in the state of overlapping with the base portion 51. In the reverse feeding step, the transport unit 23 transports, with the first surface S1, which is the outer surface in the state of the roll body R, as the upper surface of the cut piece 52, the cut piece 52 from downstream from the cutting unit 25 to upstream from the cutting unit 25.

The control unit 49 reversely drives of the pair of first rollers 41, in a state where the pair of second rollers 42 are reversely driven in the superposing step, to perform the reverse feeding step. In other words, the control unit 49, in the superposing step and the reverse feeding step, drives the transport unit 23 such that the pair of first rollers 41 start rotating after the pair of second rollers 42. For example, the control unit 49 may individually control driving of a motor rotating the pair of first rollers 41 and a motor rotating the pair of second rollers 42. The transport unit 23 may, for example, switch power transmission by a clutch, such that the pair of first rollers 41 and the pair of second rollers 42 start rotating with a time lag.

Figure 10:
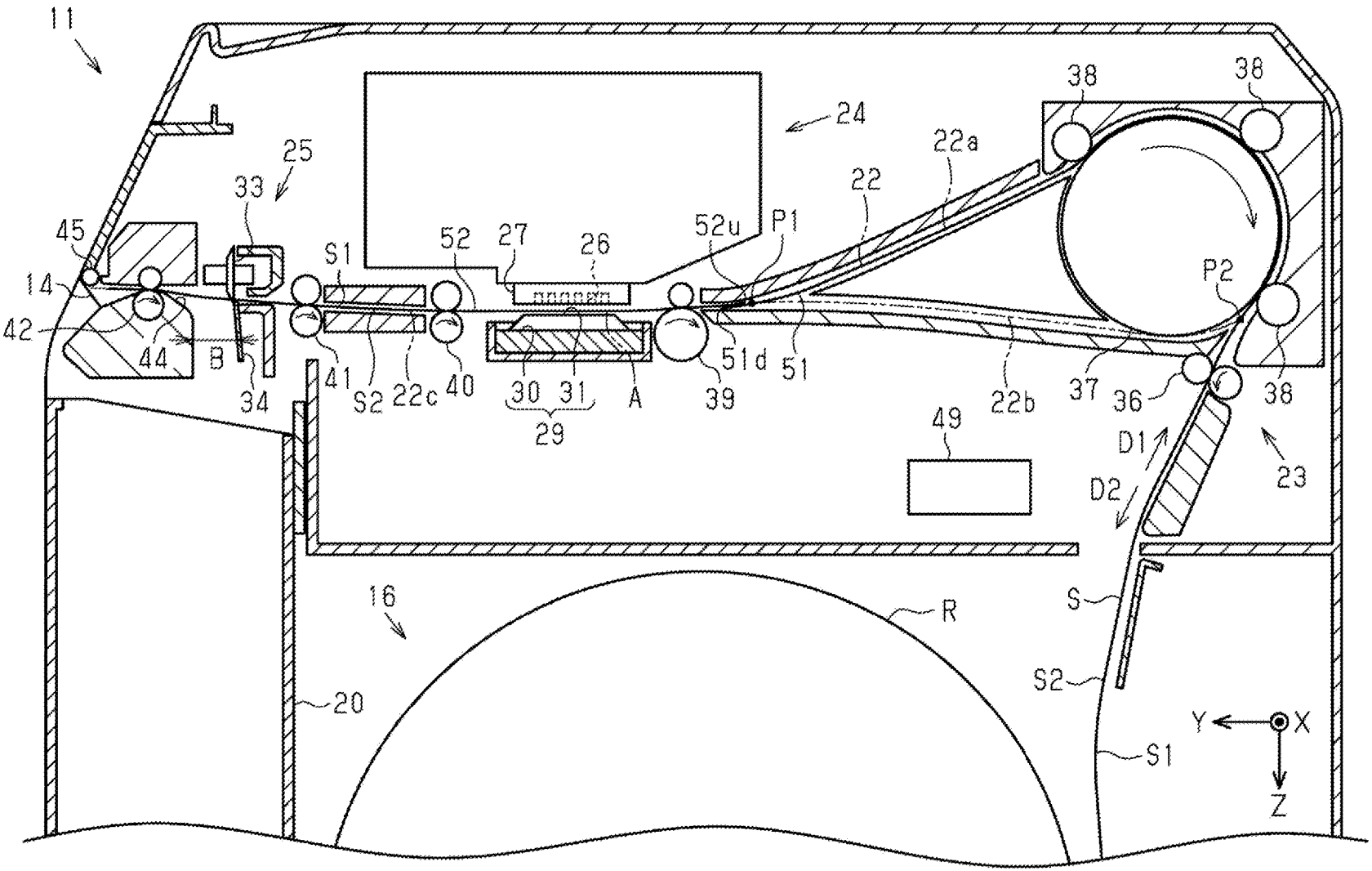
FIG. 10 is a cross-sectional view illustrating the reverse feeding step of the printing apparatus.

As illustrated in FIG. 10, the control unit 49, together with the pair of first rollers 41, reversely drives the pair of downstream transport rollers 40, the pair of upstream transport rollers 39, the reverse roller 37, and the pair of feed rollers 36. The transport unit 23 transports the cut piece 52 and the base portion 51 from downstream to upstream, such that the upstream end 52*u* of the cut piece 52 passes through the cutting unit 25, the pair of first rollers 41, the pair of downstream transport rollers 40, the support portion 29, and the pair of upstream transport rollers 39 in this order in the state of overlapping with the base portion 51. In other words, the transport unit 23, with the upstream end 52*u* of the cut piece 52 overlapping with the base portion 51, transports the upstream end 52*u* of the cut piece 52 upstream from the pair of first rollers 41. The transport unit 23, with the upstream end 52*u* of the cut piece 52 overlapping with the base portion 51, transports the upstream end 52*u* of the cut piece 52 upstream from the ink receiver 30.

When the upstream end 52*u* of the cut piece 52 and the downstream end 51*d* of the base portion 51 transported upstream from downstream pass through the pair of upstream transport rollers 39, the control unit 49 stops driving the pair of upstream transport rollers 39, the pair of downstream transport rollers 40, the pair of first rollers 41, and the pair of second rollers 42. Specifically, the control unit 49 stops transporting the cut piece 52 such that an overlapping portion of the cut piece 52 and the base portion 51 is located upstream from the pair of upstream transport rollers 39, and the upstream end 52*u* of the cut piece 52 is located between the branch point P1 where the reverse path 22*b* branches from the supply path 22*a* and the pair of upstream transport rollers 39.

Figure 11:
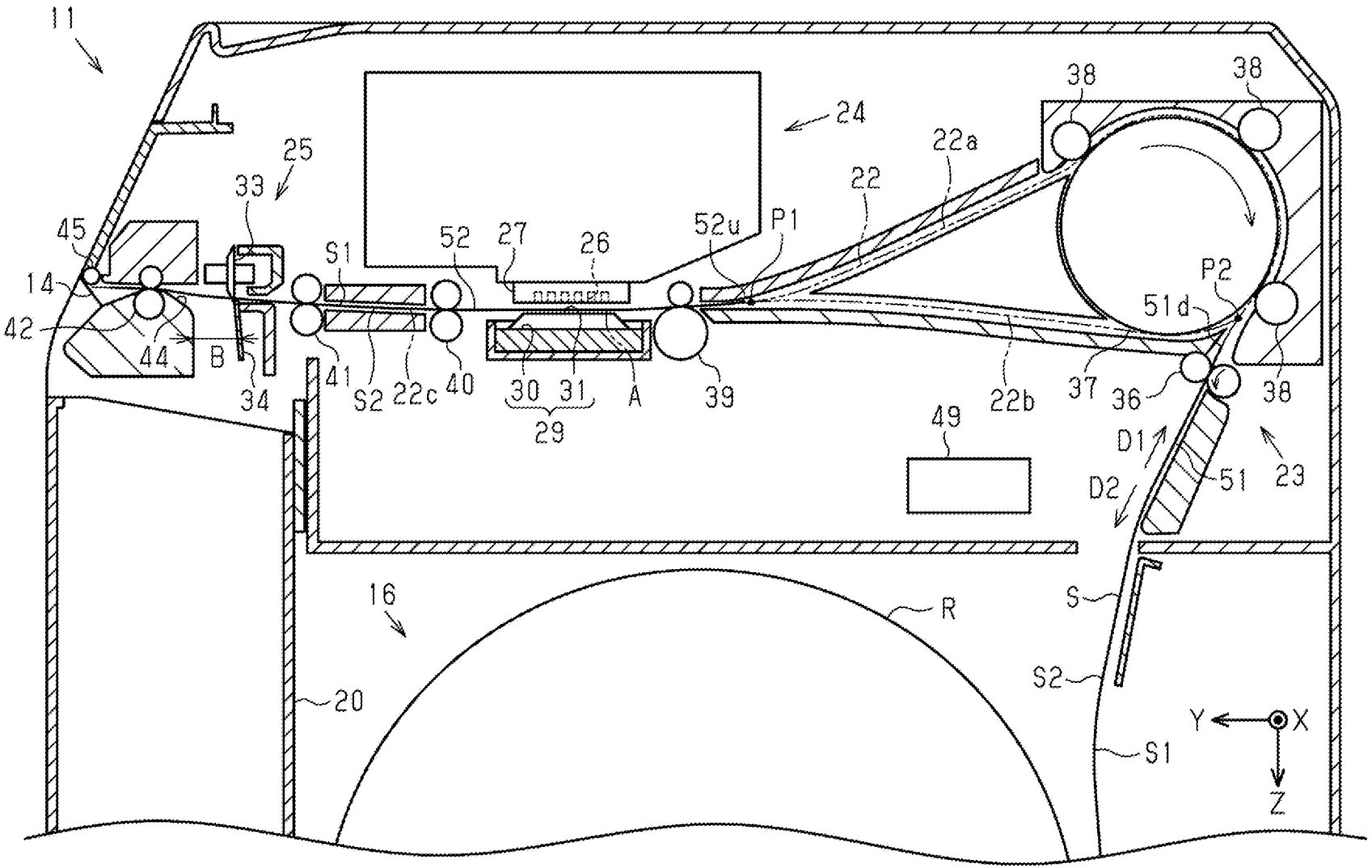
FIG. 11 is a cross-sectional view illustrating the reverse feeding step of the printing apparatus.

As illustrated in FIG. 11, whereas the control unit 49 stops driving the pair of upstream transport rollers 39, the pair of downstream transport rollers 40, the pair of first rollers 41, and the pair of second rollers 42, the control unit 49 continues reverse driving of the reverse roller 37 and the pair of feed rollers 36. As such, whereas the upstream end 52*u* of the cut piece 52 remains located between the pair of upstream transport rollers 39 and the branch point P1, the base portion 51 is transported in the reverse feeding direction D2. As the downstream end 51*d* of the base portion 51 passes through the joining point P2, the control unit 49 stops driving the reverse roller 37 and the pair of feed rollers 36.

Figure 12:
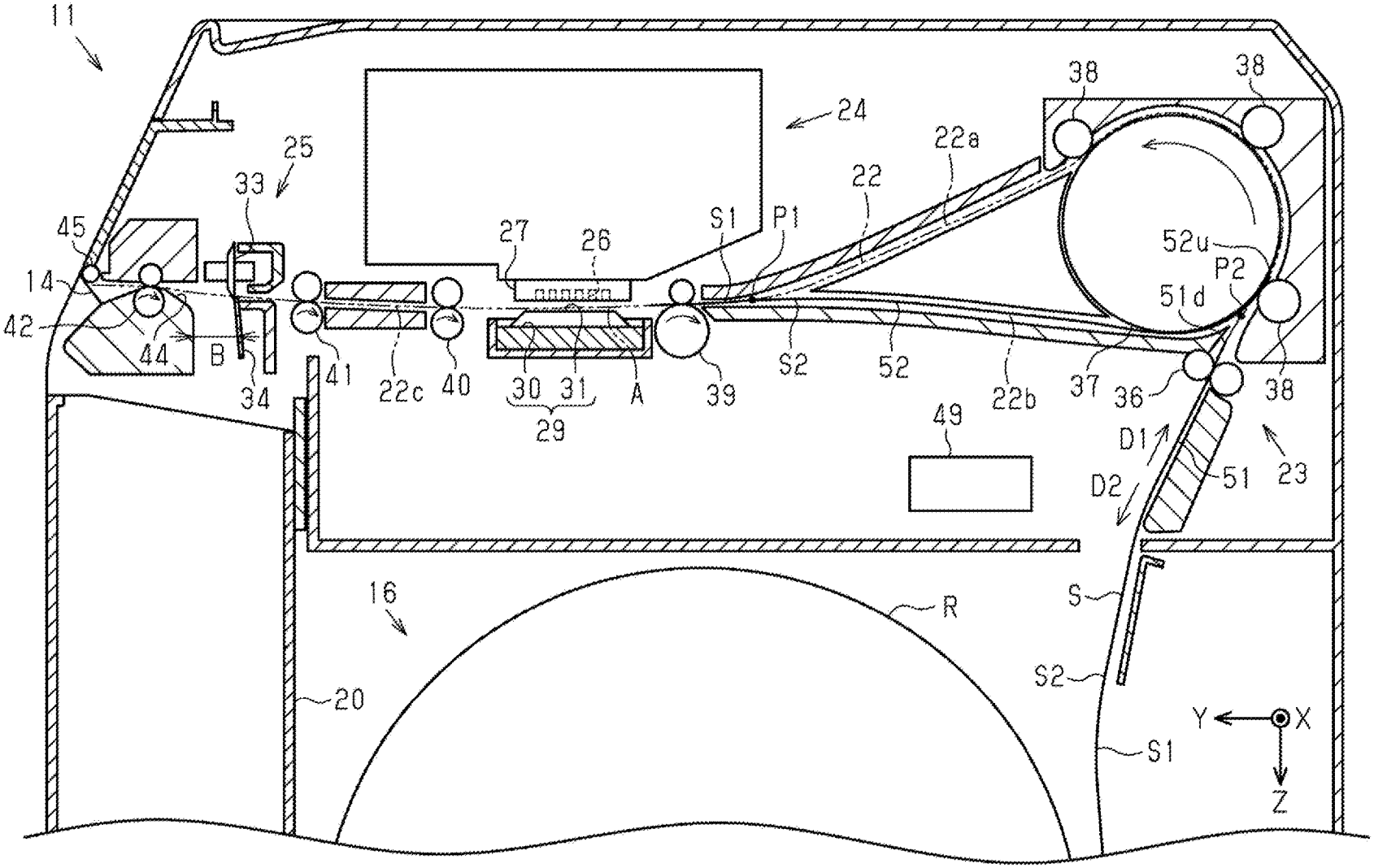
FIG. 12 is a cross-sectional view illustrating the reverse step of the printing apparatus.

As illustrated in FIG. 12, the control unit 49 performs the reverse step such that the second surface S2 of the cut piece 52 becomes an upper surface. In the reverse step, the control unit 49 drives the reverse roller 37 forward in a state where the driving of the pair of feed rollers 36 is stopped, and reversely drives the pair of upstream transport rollers 39, the pair of downstream transport rollers 40, the pair of first rollers 41, and the pair of second rollers 42. The transport unit 23 transports the cut piece 52 in the reverse feeding direction D2, transmits the cut piece 52 from the branch point P1 to the reverse path 22*b*, and returns the cut piece 52 from the joining point P2 to the supply path 22*a*. The cut piece 52 returned to the supply path 22*a* is transported in the supply path 22*a* in the forward feeding direction D1. As the downstream end of the cut piece 52 passes through the pair of upstream transport rollers 39, the control unit 49 switches the reverse driving of the pair of upstream transport rollers 39, the pair of downstream transport rollers 40, the pair of first rollers 41, and the pair of second rollers 42 to the forward driving.

In the cut piece 52, upstream is replaced with downstream by the reverse step, and the upstream end 52*u* becomes a lowermost stream end, and the second surface S2 becomes the upper surface. When the cut piece 52 passes through the joining point P2, the control unit 49 drives the stopped pair of feed rollers 36 forward.

Figure 13:
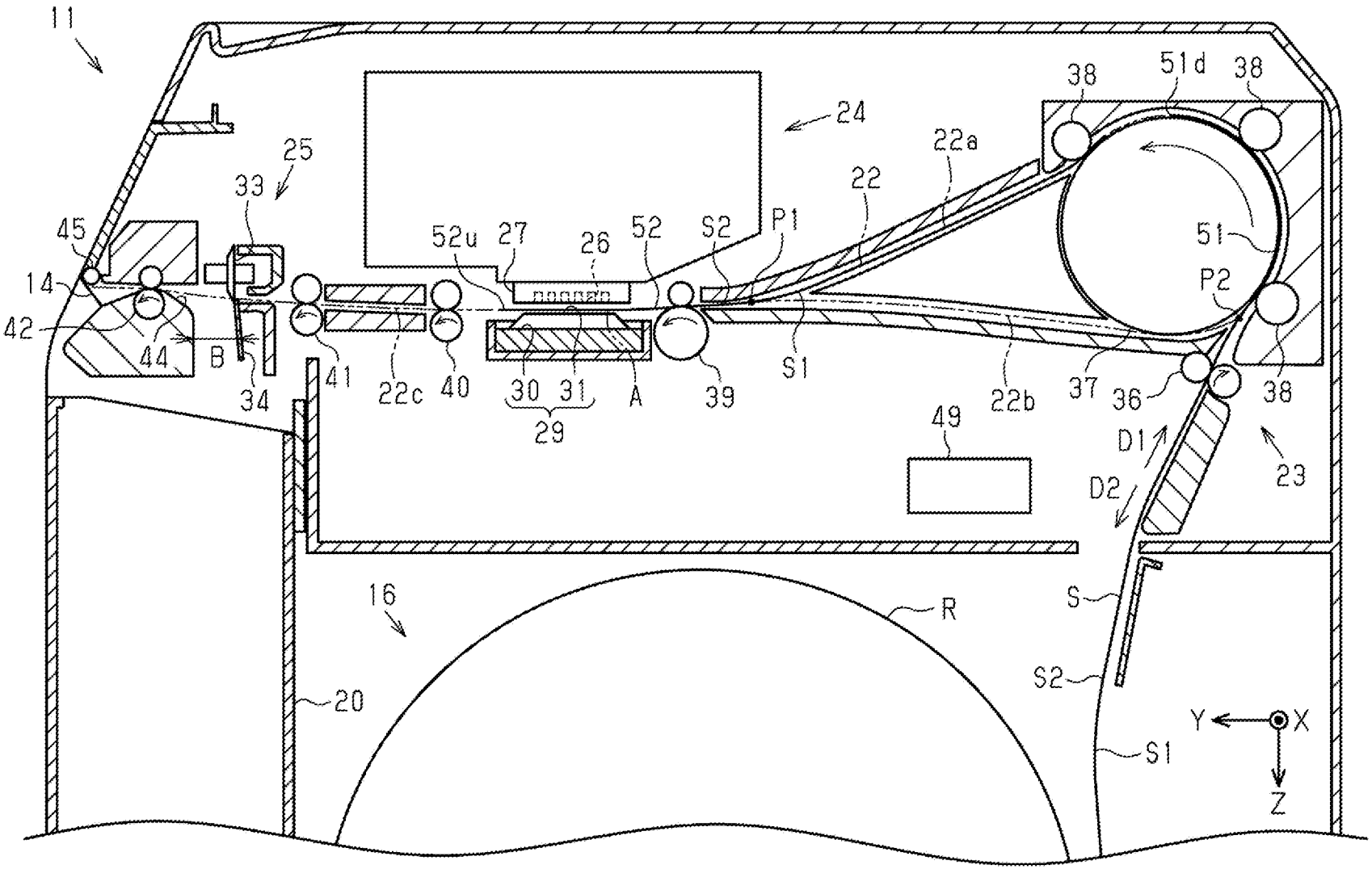
FIG. 13 is a cross-sectional view illustrating a second printing step of the printing apparatus.

As illustrated in FIG. 13, the control unit 49 performs the second printing step for printing on the cut piece 52. In the second printing step, while the transport unit 23 transports the medium S in the forward feeding direction D1, the printing unit 24 discharges ink toward the second surface S2 of the medium S located in the print region A to perform printing.

When a margin portion passes through the cutting location, the control unit 49 performs the cut-off step in which the removed cut piece 47 is cut off from the cut piece 52, in a state where the driving of the transport unit 23 is stopped. At this time, the portion cut off from the cut piece 52 includes the portion overlapping with the base portion 51 in the superposing step and the reverse feeding step. Thereafter, the control unit 49 discharges the cut piece 52 in which both sides are printed from the discharge port 14.

Effects of the present exemplary embodiment will now be described.

(1) In the state where the upstream end 52*u* of the cut piece 52 overlaps with the base portion 51, the transport unit 23 transports the upstream end 52*u* of the cut piece 52 from downstream from the cutting unit 25 to upstream from the cutting unit 25. In other words, the cut piece 52 is transported from downstream to upstream while being supported by the base portion 51, and the upstream end 52*u* passes through the cutting unit 25. Thus, even when the cut piece 52 located in the transport path 22, which has a larger height downstream from the cutting unit 25, for example, is transported to the transport path 22, which has a smaller height upstream from the cutting unit 25, the cut piece 52 can be guided by the base portion 51, and the cut piece 52 located downstream from the cutting unit 25 can be transported upstream from the cutting unit 25.

(2) The contact portion 44 is located below the upstream end 52*u* of the cut piece 52 held by the pair of second rollers 42 in the vertical direction Z. Thus, by bringing the downstream end 51*d* of the base portion 51 into contact with the contact portion 44, the base portion 51 can be located below the cut piece 52 held by the pair of second rollers 42, and the cut piece 52 can be easily overlapped on the base portion 51.

(3) In the state where the upstream end 52*u* of the cut piece 52 overlaps with the base portion 51, the transport unit 23 transports the upstream end 52*u* of the cut piece 52 from downstream from the pair of first rollers 41 to upstream from the pair of first rollers 41. In other words, the upstream end 52*u* of the cut piece 52 passes through the pair of first rollers 41 in the state of overlapping with the base portion 51. As such, the transport unit 23 can guide the cut piece 52 between the pair of first rollers 41 that sandwich and transport the medium S, by the base portion 51. Thus, the cut piece 52 can be easily sandwiched between the pair of first rollers 41.

(4) The transport unit 23, with the cut piece 52 overlapping with the base portion 51, transports the upstream end 52*u* of the cut piece 52 from downstream from the ink receiver 30 to upstream from the ink receiver 30. Thus, the upstream end 52*u* of the cut piece 52 passes through the ink receiver 30 in the state of overlapping with the base portion 51. Thus, even when the support portion 29 includes the ink receiver 30, a possibility that the cut piece 52 comes into contact with the ink receiver 30 and becomes dirty can be reduced.

(5) the pair of second rollers 42 and the guide portion 45 are provided downstream from the cutting unit 25. The cut piece 52 transported by the pair of second rollers 42 are guided by the guide portion 45. Accordingly, behavior of the cut piece 52 can be stabilized.

(6) The upstream end 52*u* of the cut piece 52 overlapping with the base portion 51 is located above the base portion 51. Thus, for example, even when the accommodating portion 20 accommodating the removed cut piece 47 cut off from the medium S is provided below the cutting unit 25, the cut piece 52 can be supported from below by the base portion 51.

(7) The cut piece 52, which is obtained by cutting the medium S wound in the cylindrical shape, is curled in some cases. In other words, in a state where the first surface S1 outside in the state of the roll body R becomes the upper surface of the cut piece 52, an end of the cut piece 52 is easily curled downward. In that regard, the upstream end 52*u* of the cut piece 52 is located above the base portion 51 in the state of overlapping with the base portion 51. Thus, the upstream end 52*u* of the cut piece 52 that is easily curled downward can be supported from below by the base portion 51.

The present exemplary embodiment described above may be modified as follows. The present exemplary embodiment and modified examples thereof to be described below may be implemented in combination within a range in which a technical contradiction does not arise.

The printing apparatus 11 may transport the cut piece 52 in the reverse feeding direction D2, with the second surface S2 inside in the state of the roll body R as the upper surface of the cut piece 52. The upstream end 52*u* of the cut piece 52 may be located below the base portion 51 in the state of overlapping with the base portion 51. In a state where the second surface S2 inside in the state of the roll body R becomes the upper surface of the cut piece 52, the end of the cut piece 52 is easily curled upward. Thus, since the upstream end 52*u* of the cut piece 52 overlaps with the base portion 51 from below, the cut piece 52 can be held down by the base portion 51.

The printing apparatus 11 may initiate printing from an end of the medium S such that a margin portion is not formed. The cutting unit 25 need not cut the removed cut piece 47. The printing apparatus 11 may discharge the cut piece 52 with a margin portion left from the discharge port 14.

The printing apparatus 11 may be configured not to include the accommodating portion 20. For example, the printing apparatus 11 may transport the removed cut piece 47 in the forward feeding direction Dl and discharge the removed cut piece 47 from the discharge port 14. The printing apparatus 11 may extract the removed cut piece 47 cut off from the medium S in the width direction X, or may take the cut piece 47 away upward. In these cases, the gap B between the contact portion 44 and the cutting unit 25 may be smaller than the removed cut piece 47.

The guide portion 45 may be located upstream from the pair of second rollers 42.

The printing apparatus 11 may include a holding unit that holds the cut piece 52 separately from the pair of second rollers 42. The holding unit may be, for example, a platform that supports the cut piece 52 from below, or may hold the cut piece 52 by suction.

The printing apparatus 11 may transport the cut piece 52 in the reverse feeding direction D2 in the state of overlapping with the base portion 51, and when the upstream end 52*u* of the cut piece 52 passes through the cutting unit 25, the overlap of the cut piece 52 and the base portion 51 may be released. That is, when the upstream end 52*u* of the cut piece 52 passes through the cutting unit 25, the control unit 49 may temporarily stop driving the pair of second rollers 42.

The printing apparatus 11 may transport the cut piece 52 in the reverse feeding direction D2 in the state of overlapping with the base portion 51, and when the upstream end 52*u* of the cut piece 52 passes through the pair of first rollers 41, the overlap of the cut piece 52 and the base portion 51 may be released. That is, when the upstream end 52*u* of the cut piece 52 and the downstream end 51*d* of the base portion 51 pass through the first pair of rollers 41, the control unit 49 may temporarily stop driving the pair of second rollers 42 and the pair of first rollers 41.

The printing apparatus 11 may transport the cut piece 52 in the reverse feeding direction D2 in the state of overlapping with the base portion 51, and when the upstream end 52*u* of the cut piece 52 passes through the support portion 29, the overlap of the cut piece 52 and the base portion 51 may be released. When the upstream end 52*u* of the cut piece 52 passes through the support portion 29, the control unit 49 may temporarily stop driving the pair of second rollers 42, the pair of first rollers 41, and the pair of downstream transport rollers 40.

The printing apparatus 11 may be an apparatus that prints an image such as characters, pictures, photographs, and the like by depositing a liquid such as ink or a fluid body such as toner on a medium, and may be a serial printer, a lateral printer, a line printer, a page printer, or the like. Further, the printing apparatus may be an offset printing apparatus, a textile printing apparatus, or the like. It is sufficient that the printing apparatus have at least a printing function for printing on a medium, and the printing apparatus may be a composite machine having functions other than the printing function.

Hereinafter, technical concepts and effects thereof that are understood from the above-described exemplary embodiments and modified examples will be described.

(A) A printing apparatus includes a transport unit configured to transport a medium, a printing unit configured to perform printing on the medium, and a cutting unit configured to cut the medium, wherein the cutting unit located downstream from the printing unit cuts the medium into a base portion upstream from the cutting unit, and a cut piece downstream from the cutting unit, and the transport unit, with an upstream end of the cut piece in a state of being superposed over the base portion, transports the upstream end of the cut piece from downstream from the cutting unit to upstream from the cutting unit.

According to this configuration, in a state where the upstream end of the cut piece overlaps above the base portion, the transport unit transports the upstream end of the cut piece from downstream from the cutting unit to upstream from the cutting unit. In other words, the cut piece is transported from downstream to upstream while being supported by the base portion, and the upstream end passes through the cutting unit. Thus, even when the cut piece located in a transport path, which has a larger height downstream from the cutting unit, for example, is transported to the transport path, which has a smaller height upstream from the cutting unit, the cut piece can be guided by the base portion, and the cut piece located downstream from the cutting unit can be transported upstream from the cutting unit.

(B) The printing apparatus may include a holding unit holding the cut piece downstream from the cutting unit, and a contact portion capable of contacting a downstream end of the base portion below the upstream end of the cut piece in a state of being held by the holding unit in a vertical direction.

According to this configuration, the contact portion is located below the upstream end of the cut piece held by the holding unit in the vertical direction. Thus, by bringing the downstream end of the base portion into contact with the contact portion, the base portion can be located below the cut piece held by the holding unit, and the cut piece can be easily overlapped on the base portion.

(C) In the printing apparatus, the transport unit may include a pair of first rollers located upstream from the cutting unit, and the transport unit may, with the upstream end of the cut piece in a state of being superposed over the base portion, transport the upstream end of the cut piece upstream from the pair of first rollers.

According to this configuration, in a state where the upstream end of the cut piece overlaps with the base portion, the transport unit transports the upstream end of the cut piece from downstream from the pair of first rollers to upstream from the pair of first rollers. In other words, the upstream end of the cut piece passes through the pair of first rollers in a state of overlapping with the base portion. As such, the transport unit can guide the cut piece between the pair of first rollers that sandwich and transport the medium, by the base portion. Thus, the cut piece can be easily sandwiched between the pair of first rollers.

(D) The printing apparatus may further include a support portion including an ink receiver configured to receive ink discharged from the printing unit, and a support face configured to support the medium, the transport unit, with the upstream end of the cut piece in a state of being superposed over the base portion, may transport the upstream end of the cut piece upstream from the ink receiver.

According to this configuration, with the cut piece overlapping with the base portion, the transport unit transports the upstream end of the cut piece from downstream from the ink receiver to upstream from the ink receiver. Thus, the upstream end of the cut piece passes through the ink receiver in the state of overlapping with the base portion. Thus, even when the support portion includes the ink receiver, a possibility that the cut piece comes into contact with the ink receiver and becomes dirty can be reduced.

(E) The printing apparatus may further include a guide portion capable of contacting an upper surface of the cut piece to guide the cut piece, and the transport unit may include a pair of second rollers located downstream from the cutting unit, and the guide portion may be provided downstream from the pair of second rollers.

According to this configuration, the pair of second rollers and the guide portion are provided downstream from the cutting unit. The cut piece transported by the pair of second rollers is guided by the guide portion. Thus, behavior of the cut piece can be stabilized.

(F) In the printing apparatus, the cutting unit may be capable of cutting the medium into the base portion, the cut piece, and a removed cut piece, a housing including a discharge port from which the cut piece is discharged, and an accommodating portion for accommodating the removed cut piece cut off from the medium may be further included, and the upstream end of the cut piece may be located above the base portion in a state of overlapping with the base portion.

According to this configuration, the upstream end of the cut piece overlapping with the base portion is located above the base portion. Thus, for example, even when the accommodating portion for accommodating the removed cut piece cut off from the medium is provided below the cutting unit, the cut piece can be supported from below by the base portion.

(G) In the printing apparatus, the transport unit may unwind the medium from a roll body around which the medium is wound, transport the medium, and transport an outer surface in a state of the roll body upstream from the cutting unit as an upper surface of the cut piece.

The cut piece, which is obtained by cutting the medium wound in a cylindrical shape, is curled in some cases. In other words, in a state where the outer surface in the state of the roll body becomes the upper surface of the cut piece, an end of the cut piece is easily curled downward. In that regard, according to this configuration, the upstream end of the cut piece is located above the base portion in the state of overlapping with the base portion. Thus, the upstream end of the cut piece that is easily curled downward can be supported from below by the base portion.

(H) A transport control method is a transport control method for a printing apparatus including a transport unit configured to transport a medium, a printing unit configured to perform printing on the medium, and a cutting unit configured to cut the medium, that includes a forward feeding step for transporting downstream the medium printed by the printing unit, a cutting step for, after the forward feeding step, cutting, by the cutting unit, the printed medium into a base portion upstream from the cutting unit and a cut piece downstream from the cutting unit, an superposing step for superposing an upstream end of the cut piece above the base portion, and a reverse feeding step for, with the upstream end of the cut piece in a state of being superposed over the base portion, transporting the cut piece from downstream from the cutting unit to upstream from the cutting unit.

According to this method, a similar effect to that of the printing apparatus described above can be obtained.

What is claimed is:

1. A printing apparatus, comprising:

a transport unit configured to transport a medium;

a printing unit configured to perform printing on the medium; and a cutting unit configured to cut the medium, wherein the cutting unit located downstream of the printing unit cuts the medium into a base portion upstream of the cutting unit, and a cut piece downstream of the cutting unit, and the transport unit, with an upstream end of the cut piece in a state of being superposed over the base portion, transports the upstream end of the cut piece from downstream of the cutting unit to upstream of the cutting unit.

2. The printing apparatus according to claim 1, further comprising:

a holding unit configured to hold the cut piece downstream of the cutting unit; and a contact portion configured to contact a downstream end of the base portion downward in a vertical direction of the upstream end of the cut piece in a state of being held by the holding unit.

3. The printing apparatus according to claim 1, wherein the transport unit includes a pair of first rollers located upstream of the cutting unit, and the transport unit, with the upstream end of the cut piece in a state of being superposed over the base portion, transports the upstream end of the cut piece to upstream of the pair of first rollers.

4. The printing apparatus according to claim 1, further comprising:

a support portion including an ink receiver configured to receive ink discharged from the printing unit and a support face configured to support the medium, wherein the transport unit, with the upstream end of the cut piece in a state of being superposed over the base portion, transports the upstream end of the cut piece to upstream of the ink receiver.

5. The printing apparatus according to claim 1, further comprising:

a guide portion configured to contact an upper surface of the cut piece to guide the cut piece, wherein the transport unit includes a pair of second rollers located downstream of the cutting unit, and the guide portion is provided downstream of the pair of second rollers.

6. The printing apparatus according to claim 1, wherein the cutting unit is configured to cut the medium into the base portion, the cut piece, and a removed cut piece, a housing including a discharge port from which the cut piece is discharged, and an accommodating portion for accommodating the removed cut piece cut off from the medium are further included, and the upstream end of the cut piece is located over the base portion in a state of overlapping with the base portion.

7. The printing apparatus according to claim 6, wherein the transport unit unwinds the medium from a roll body around which the medium is wound and transports the medium, and transports the cut piece to upstream of the cutting unit with an outer surface of the medium in a state of the roll body being an upper surface of the cut piece.

8. A transport control method for a printing apparatus including a transport unit configured to transport a medium, a printing unit configured to perform printing on the medium, and a cutting unit configured to cut the medium, the transport control method comprising:

a forward feeding step for transporting downstream the medium printed by the printing unit;

a cutting step for, after the forward feeding step, cutting, by the cutting unit, the printed medium into a base portion upstream of the cutting unit and a cut piece downstream of the cutting unit;

an superposing step for superposing an upstream end of the cut piece over the base portion; and a reverse feeding step for, with the upstream end of the cut piece in a state of being superposed over the base portion, transporting the cut piece from downstream of the cutting unit to upstream of the cutting unit.

* * * * *